US010543404B2

(12) United States Patent
Kohno et al.

(10) Patent No.: US 10,543,404 B2
(45) **Date of Patent: *Jan. 28, 2020**

(54) GOLF CLUB HEAD

(71) Applicant: SUMITOMO RUBBER INDUSTRIES, LTD., Kobe-shi (JP)

(72) Inventors: Daisuke Kohno, Kobe (JP); Naruhiro Mizutani, Kobe (JP)

(73) Assignee: SUMITOMO RUBBER INDUSTRIES, LTD., Kobe-shi, Hyogo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/647,494

(22) Filed: Jul. 12, 2017

(65) Prior Publication Data

US 2018/0015336 A1 Jan. 18, 2018

(30) Foreign Application Priority Data

Jul. 13, 2016 (JP) ..... 2016-138499

(51) Int. Cl.
*A63B 53/04* (2015.01)
*A63B 53/02* (2015.01)

(52) U.S. Cl.
CPC ..... *A63B 53/04* (2013.01); *A63B 53/02* (2013.01); *A63B 53/047* (2013.01); *A63B 2053/0408* (2013.01); *A63B 2053/0416* (2013.01)

(58) Field of Classification Search
CPC ... A63B 53/0466; A63B 53/04; A63B 53/047; A63B 53/02; A63B 2053/0416; A63B 2053/045; A63B 2053/0491; A63B 2053/0408
See application file for complete search history.

(56) References Cited

U.S. PATENT DOCUMENTS

| | | | | |
|---|---|---|---|---|
| 7,294,064 | B2 * | 11/2007 | Tsurumaki | A63B 53/0466 473/329 |
| 8,517,860 | B2 * | 8/2013 | Albertsen | A63B 53/0466 473/329 |
| 2016/0096082 | A1 * | 4/2016 | Boggs | A63B 53/04 473/324 |
| 2016/0346642 | A1 * | 12/2016 | Akiyama | A63B 53/0466 |

* cited by examiner

*Primary Examiner* — Michael D Dennis
(74) *Attorney, Agent, or Firm* — Birch, Stewart, Kolasch & Birch, LLP

(57) ABSTRACT

The golf club head of the present invention includes a face portion, a crown portion, and a sole portion. The golf club head also has an interior space surrounded by the face portion, the crown portion, and the sole portion. A first channel and a second channel that extend in a toe-heel direction and are recessed toward the interior space side are formed in the sole portion. The first channel is disposed on a face side relative to the second channel, and has a first main inner wall disposed on the face side, and a first sub inner wall disposed on a back side. The first main inner wall is formed with a longer length in a face-back direction than the first sub inner wall, and is inclined so as to extend upward while extending toward the back side.

10 Claims, 11 Drawing Sheets

E1 corss-section

GOLF CLUB HEAD

TECHNICAL FIELD

The present invention relates to a golf club head.

BACKGROUND ART

Improvement of flight distance is a permanent theme of golfers. Therefore, in the design of golf club heads, various plans have been devised in order to improve the rebound performance of golf club heads.

Incidentally, a golf club head having a plurality of channels formed in a sole portion is disclosed in Patent Literature 1.

CITATION LIST

Patent Literature

Patent Literature 1: Specification of U.S. Pat. No. 8,517,860

SUMMARY OF INVENTION

In many cases, channels formed in a sole portion contribute to improvement of rebound performance of a golf club head. However, when aiming to further improve rebound performance, it is not sufficient to merely form channels, and further improvements in the configuration of channels have been sought. The inventors of the present invention, particularly in a case of forming a plurality of channels, considered it important to further improve the relative configuration of those channels.

An object of the present invention is to provide a golf club head having high rebound performance.

A golf club head according to the present invention includes: a face portion; a crown portion; and a sole portion, wherein the golf club head has an interior space surrounded by the face portion, the crown portion, and the sole portion, a first channel and a second channel that extend in a toe-heel direction and are recessed toward the interior space are formed in the sole portion, the first channel is disposed on a face side relative to the second channel, the first channel has a first main inner wall disposed on the face side, and a first sub inner wall disposed on a back side, the first main inner wall is formed with a longer length in a face-back direction than the first sub inner wall, and is inclined so as to extend upward while extending toward the back side, the second channel has a second sub inner wall disposed on the face side, and a second main inner wall disposed on the back side, and the second main inner wall is formed with a longer length in the face-back direction than the second sub inner wall, and is inclined so as to extend upward while extending toward the face side.

In the above golf club head, the second channel may be deeper than the first channel.

In the above golf club heads, the first channel may be formed due to the first main inner wall disposed on the face side being connected to the first sub inner wall disposed on the back side, and the second channel may be formed due to the second sub inner wall disposed on the face side being connected to the second main inner wall disposed on the back side.

In the above golf club heads, the sole portion may further include a first grounding portion positioned on the face side relative to the first channel and contacting a ground plane when the sole portion has been placed on the ground plane, and a second grounding portion positioned between the first channel and the second channel and contacting the ground plane when the sole portion has been placed on the ground plane.

In the above golf club heads, in the side cross-sectional view, the first grounding portion and the second grounding portion may be configured so as to contact the ground plane in a line when the sole portion has been placed on the ground plane.

In the above golf club heads, the sole portion may further include a third grounding portion positioned on the back side relative to the second channel and contacting the ground plane when the sole portion has been placed on the ground plane.

In the above golf club heads, the sole portion may further include a thick portion extending in the toe-heel direction in at least one of the first main inner wall and the second main inner wall.

In the above golf club heads, the sole portion may further include a thick portion extending in the face-back direction in at least a position of the first channel.

In the above golf club heads, the first channel may be shorter than the second channel in the toe-heel direction.

In the above golf club heads, in a plan view, at least one of the first channel and the second channel may extend in a shape protruding toward the back side.

A golf club head according to the present invention makes it possible to raise rebound performance.

DESCRIPTION OF EMBODIMENTS

A golf club head according to several embodiments of the present invention will be described below, with reference to the drawings.

1. Outline of Golf Club Head

Figure 1:
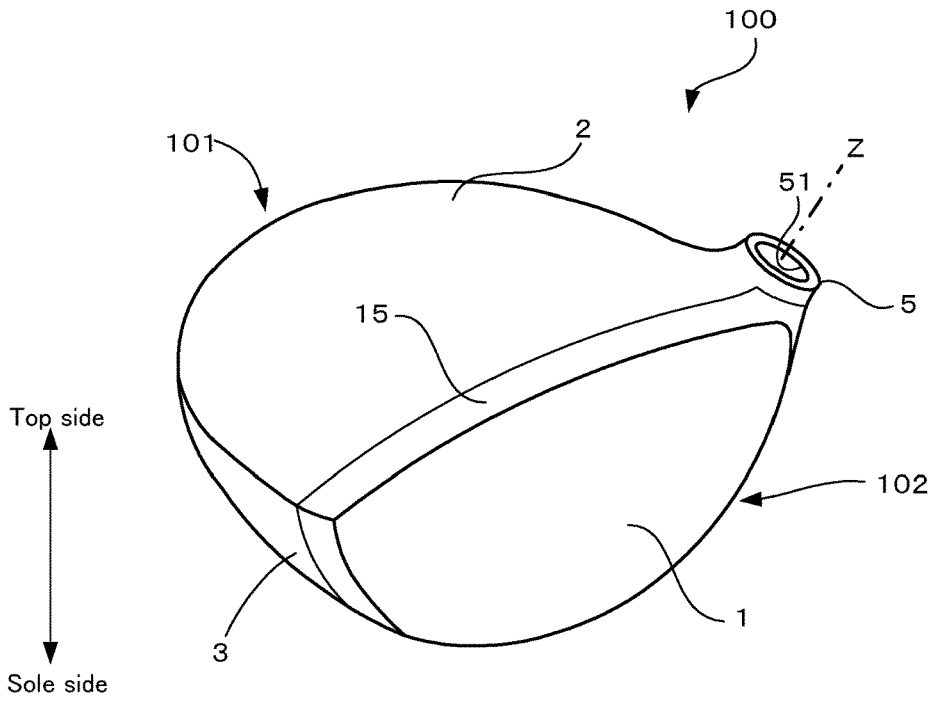
FIG. 1 is a perspective view of a golf club head according to a first embodiment of the present invention.
Figure 2:
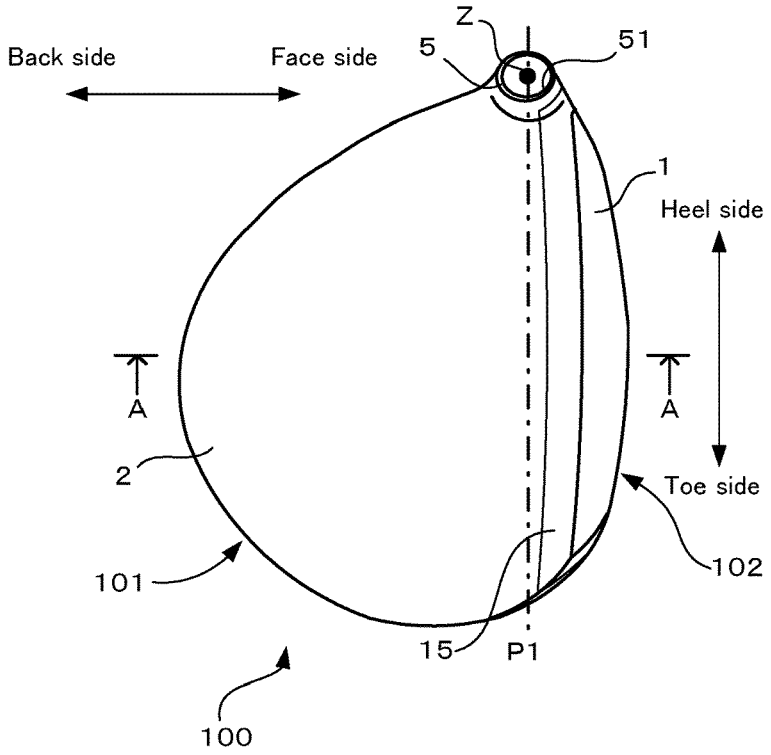
FIG. 2 is a plan view of a reference state of the golf club head in FIG. 1.
Figure 3:
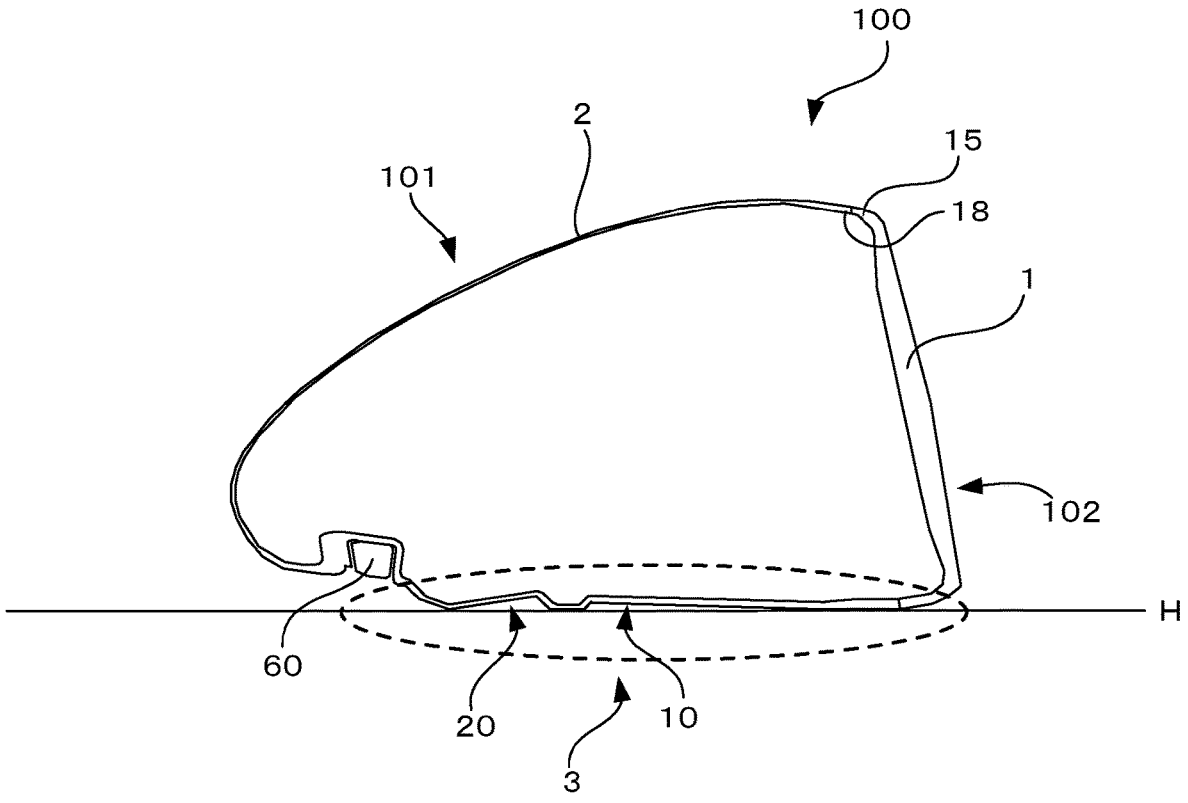
FIG. 3 is cross-sectional view taken along line A-A in FIG. 2.

FIG. 1 is a perspective view of a golf club head, FIG. 2 is a plan view of a reference state of a head, and FIG. 3 is a cross-sectional view taken along line A-A in FIG. 2. As shown in FIG. 1, a golf club head (hereinafter, may simply be referred to as the "head") 100 is wood-type golf club head that is a hollow structure having an interior space, in which a wall surface is formed by a face portion 1, a crown portion 2, a sole portion 3, and a hosel portion 5.

The face portion 1 has a face surface, which is the surface for hitting a golf ball, and the crown portion 2 is adjacent to the face portion 1 and constitutes an upper face of the head. The sole portion 3 mainly constitutes a bottom face of the head, and constitutes the portion of the outer peripheral surface of the head 100 outside the face portion 1 and the crown portion 2. In other words, besides the bottom face of the head 100, a portion that extends from the toe side of the face portion 1, crosses the back side of the head, and extends to the heel side of the face portion 1 is also a portion of the sole portion 3. Furthermore, the hosel portion 5 is a portion that is provided adjacent to a heel side of the crown portion 2, and has an insertion hole 51 into which a golf club shaft (not shown) can be inserted. Also, a center axis Z of this insertion hole 51 coincides with the axis of the shaft.

The following describes a reference state when the golf club head 100 is placed on the ground. First, as shown in FIGS. 2 and 3, a state in which the center axis Z is included in a plane P1 that is perpendicular to a ground plane H, and the head has been placed on the ground plane at a predetermined lie angle and real loft angle, is prescribed as the reference state. The plane P1 will be referred to as the reference perpendicular plane. Also, as shown in FIG. 2, a direction of an intersection line of the reference perpendicular plane P1 and the ground plane will be referred to as a toe-heel direction, and a direction perpendicular to this toe-heel direction and parallel to the ground plane will be referred to as a face-back direction.

Figure 4A:
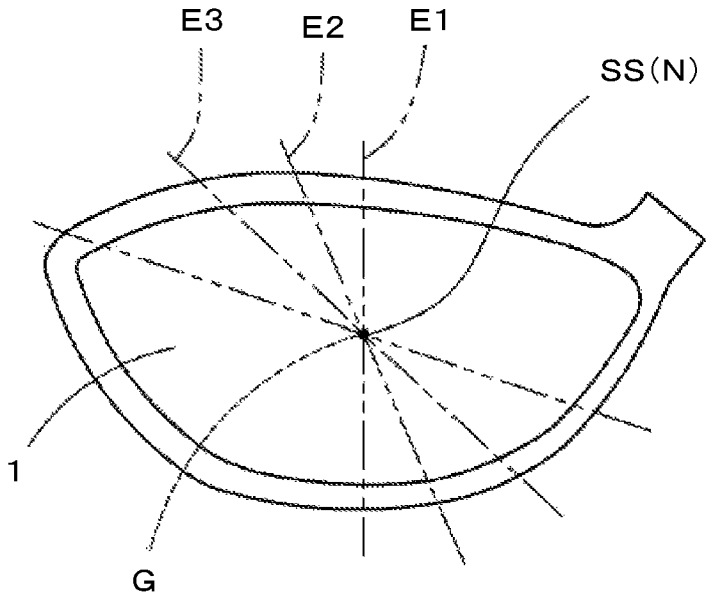
FIG. 4A is a diagram illustrating the boundary of a face portion.
Figure 4B:
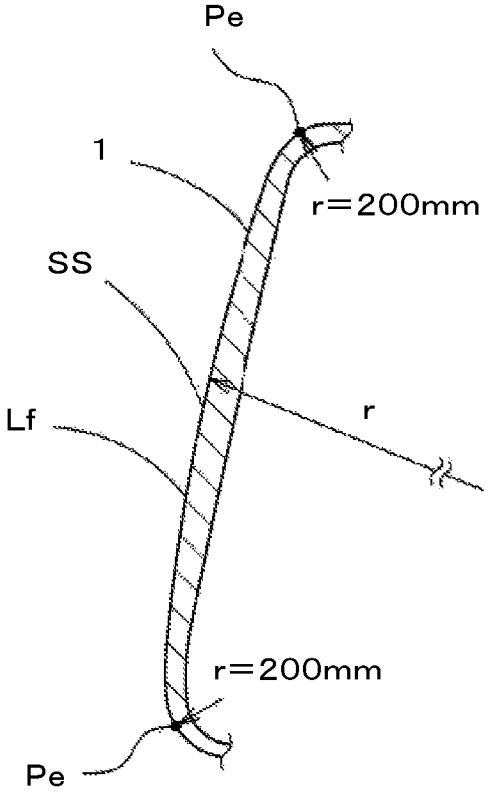
FIG. 4B is a diagram illustrating the boundary of the face portion.

In the present embodiment, the boundary between the face portion 1 and the crown portion 2, and between the face portion 1 and the sole portion 3 can be defined as follows. Specifically, if a ridge line is formed between these portions, that ridge line serves as the boundary. However, if a clear ridge line is not formed, the peripheral edge of the face portion 1 is defined by positions Pe where, in cross-sections E1, E2, E3, and so on that include a straight line N connecting a center of gravity G of the head and a sweet spot SS as shown in FIG. 4A, a radius of curvature r of an outline Lf of the outer surface of the face first reaches 200 mm when moving outward from the sweet spot side as shown in FIG. 4B, and this is also defined as the boundary with the crown portion 2 or the sole portion 3. Note that the sweet spot SS is the intersection between the face surface and a normal line (straight line N) of the face surface that passes through the center of gravity G of the head.

Also, in the present embodiment, the boundary between the crown portion 2 and the sole portion 3 can be defined as follows. Specifically, if a ridge line is formed between the crown portion 2 and the sole portion 3, that ridge line serves as the boundary. In contrast, if a clear ridge line is not formed, the boundary is the outline that is seen when the head is placed in the reference state and viewed from directly above the center of gravity of the head 100.

Also, the head 100 can, for example, be formed with a titanium alloy (for example, Ti-6Al-4V) having a specific gravity around 4.4 to 4.5. Apart from a titanium alloy, the head 100 can also be formed using one or a plurality of materials selected from among stainless steel, maraging steel, an aluminum alloy, a magnesium alloy and an amorphous alloy.

2. Assembly Structure of Golf Club Head

As shown in FIGS. 1 to 3, the golf club head 100 according to the present embodiment is constituted by assembling a head main body 101, which has the crown portion 2 and the sole portion 3, and a face member 102 formed with a cup shape having the face portion 1 and a peripheral portion 15 extending from the peripheral edge of the face portion 1. This head main body 101 has an opening 18 that is surrounded by the crown portion 2 and the sole portion 3, and the face member 102 is attached so as to block the opening 18. Specifically, the end surface of the peripheral portion 15 of the face member 102 is abutted against the end surface of the opening 18 of the head main body 101, and these two are joined by welding (so-called cup face structure). Thus, by attaching the face member 102 to the opening 18 of the head main body 101, it becomes integrated with the head main body 101, and therefore the peripheral portion 15 of the face member 102 functions as a portion of the crown portion 2 and the sole portion 3 of the head 100. Accordingly, the integral surface formed by attachment of the peripheral portion 15 of the face member 102 to the head main body 101 constitutes the crown portion 2 and the sole portion 3 of the head 100. For this reason, strictly speaking, the crown portion 2 and the sole portion 3 of the head main body 101 are portions of the crown portion 2 and the sole portion 3 of the head 100, but portions of the head main body 101 are sometimes simply referred to as the crown portion 2 and the sole portion 3 below instead of making this distinction.

The head main body 101 and the face member 102 can be joined by, for example, welding (TIG (tungsten-inert gas) welding, plasma welding, laser welding, brazing, or the like). This sort of head main body 101 and face member 102 can be manufactured using various methods. For example, the head main body 101 can be manufactured by casting such as well-known lost-wax precision casting, or the like. Also, the face member 102 can be manufactured by, for example, a forging manufacturing method, a flat plate pressing process, casting, or the like. Note that the component configuration of the head 100 described here is only an example, and it is also possible to assemble the head 100 from a plurality of components differing from the example given here.

3. Structure of Sole Portion

Figure 5:
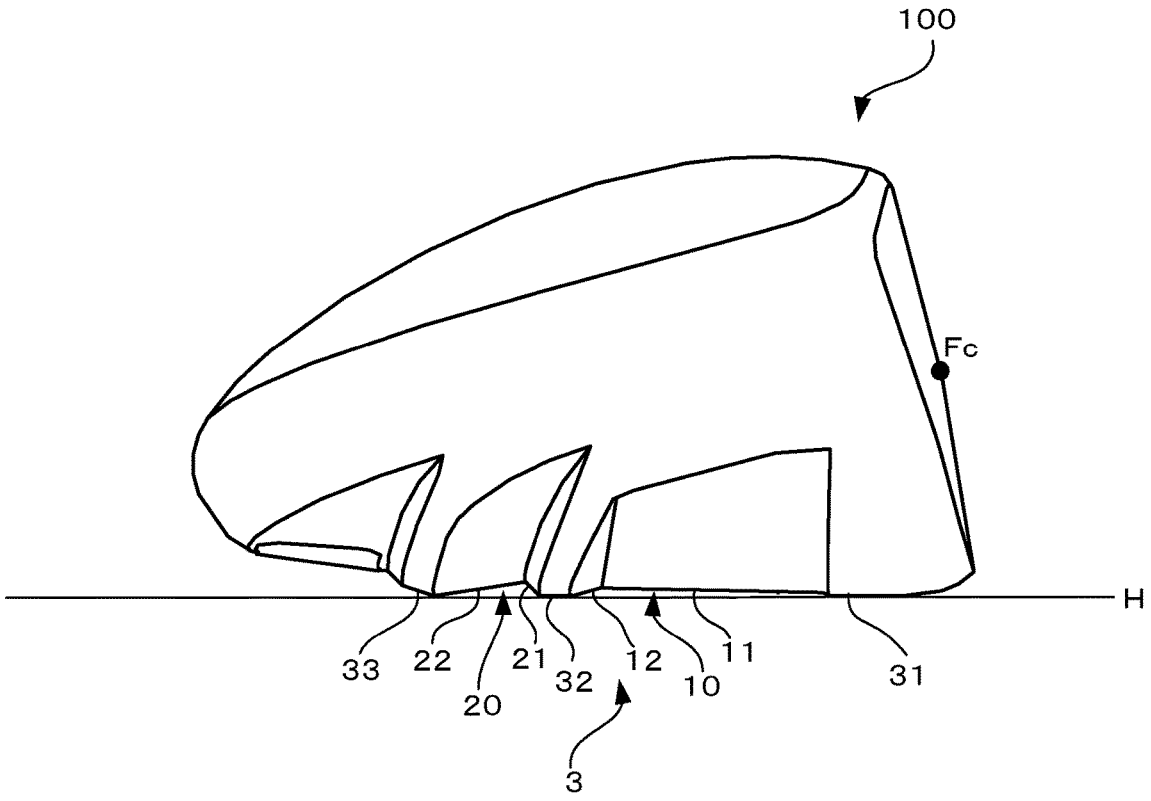
FIG. 5 is a side face view in the reference state in which the golf club head in FIG. 1 is viewed from a toe side.
Figure 6:
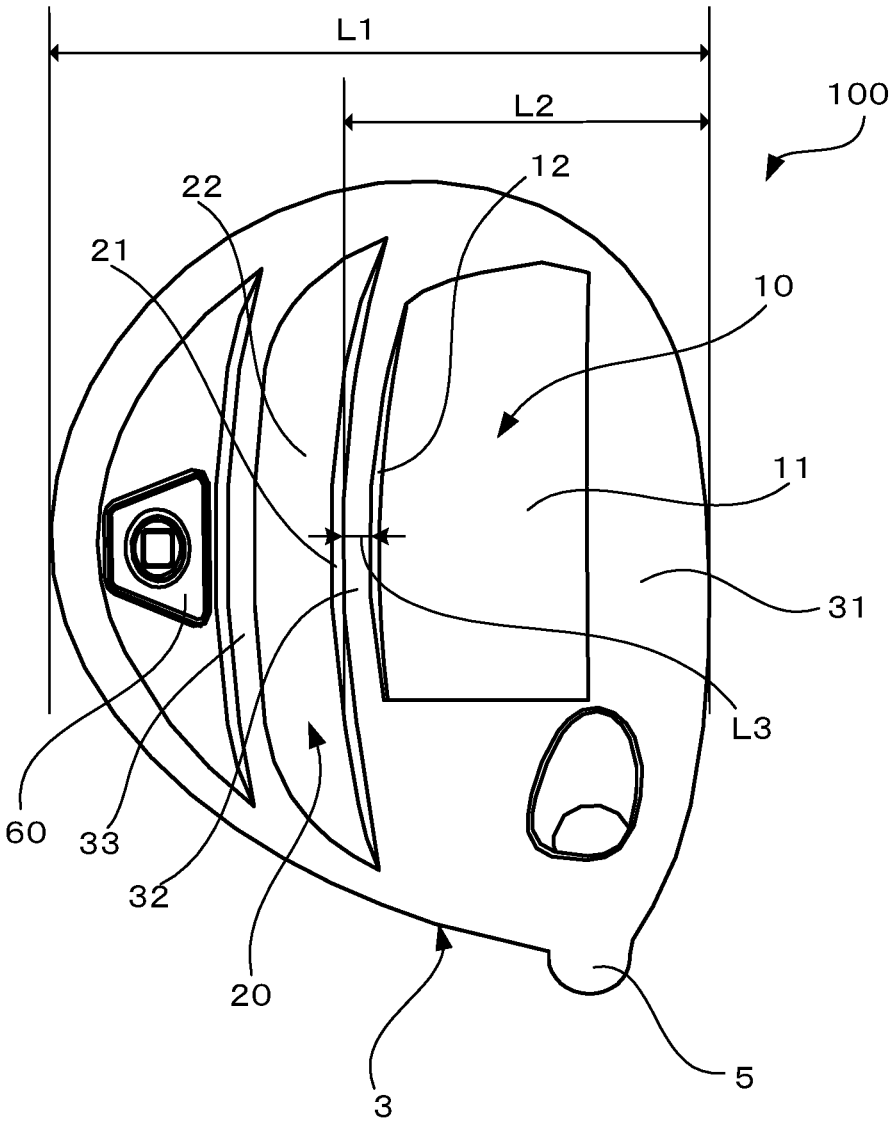
FIG. 6 is a bottom face view in the reference state of the golf club head in FIG. 1.
Figure 7:
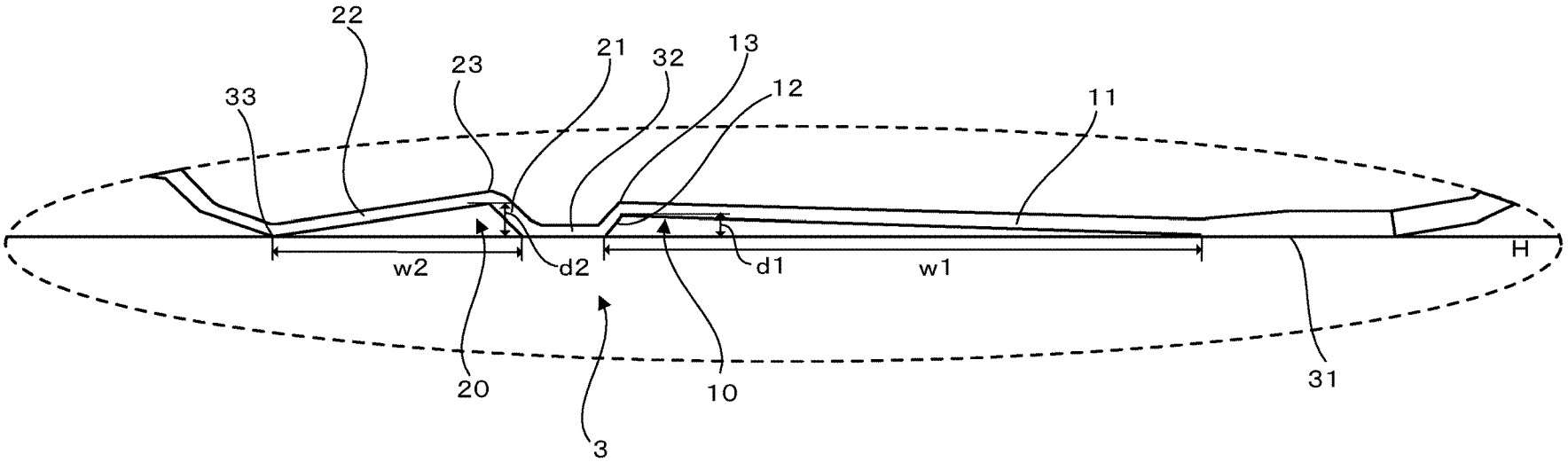
FIG. 7 is a partial enlarged view of a region in the vicinity of a sole portion surrounded by a dotted line in FIG. 3.

FIG. 5 is a side face view in the reference state in which the head 100 is viewed from the toe side, FIG. 6 is a bottom face view in the reference state of the head 100, and FIG. 7 is a partial enlarged view of a region in the vicinity of the sole portion 3 surrounded by a dotted line in FIG. 3. As shown in FIGS. 5 to 7, two channels that extend approximately parallel to each other in the toe-heel direction and recede toward the interior space are formed in the sole portion 3. Here, the channel on the face side will be referred to as a first channel 10, and the channel on the back side will be referred to as a second channel 20. Also, these channels 10 and 20 are somewhat curved so as to protrude toward the back side in a bottom face view.

As shown in FIGS. 5 to 7, the sole portion 3 has a first grounding portion 31 that is connected to the face portion 1 and is shaped as a belt that extends in the toe-heel direction, and the first channel 10 is connected to the back side of this first grounding portion 31. The first channel 10 has a rectangular shape in a bottom face view. Also, the first channel 10 has a first main inner wall 11 that extends from the face side, and a first sub inner wall 12 that is arranged on the back side of the first main inner wall 11, and the first channel 10 is roughly triangular in a side cross-sectional view due to the first main inner wall 11 being connected to the first sub inner wall 12. In other words, the first main inner wall 11 is inclined so as to extend upward (toward the crown portion 2) while extending toward the back side from the back-side end portion of the first grounding portion 31. On the other hand, the first sub inner wall 12 is inclined so as to extend downward while extending toward the back side from the back-side end portion of the first main inner wall 11. Also, the length of the first main inner wall 11 in the face-back direction is longer than that of the first sub inner wall 12, and the majority of the first channel 10 is formed by the first main inner wall 11. Note that in the following, the connection portion where the first main inner wall 11 and the first sub inner wall 12 are connected, that is to say the apex portion of the cross-sectional triangular shape, will be referred to as a first apex portion 13. This first apex portion 13 is the deepest portion of the first channel 10.

A second grounding portion 32, which is shaped as a belt that extends in the toe-heel direction, is provided on the back side of the first channel 10 in the sole portion 3. The second channel 20 is connected to the back side of this second grounding portion 32. The second channel 20 is roughly belt-shaped in a bottom face view, and has a longer length in the toe-heel direction than the first channel 10 does. In other words, the second channel 20 is formed so as to extend farther on the toe side and the heel side than the first channel 10 does. Also, the second channel 20 has a second sub inner wall 21 that extends from the second grounding portion 32, and a second main inner wall 22 that is arranged on the back side of the second sub inner wall 21, and the second channel 20 is roughly triangular in a side cross-sectional view due to the second sub inner wall 21 being connected to the second main inner wall 22. In other words, the second sub inner wall 21 is inclined so as to extend upward (toward the crown portion 2) while extending toward the back side from the back-side end portion of the second grounding portion 32. On the other hand, the second main inner wall 22 is inclined so as to extend downward while extending toward the back side from the back-side end portion of the second sub inner wall 21. Also, the length of the second main inner wall 22 in the face-back direction is longer than that of the second sub inner wall 21, and the majority of the second channel 20 is formed by the second main inner wall 22. Note that in the following, the connection portion where the second main inner wall 22 and the second sub inner wall 21 are connected, that is to say the apex portion of the cross-sectional triangular shape, will be referred to as a second apex portion 23. This second apex portion 23 is the deepest portion of the second channel 20.

Also, a third grounding portion 33, which is shaped as a belt that extends in the toe-heel direction, is provided on the back side of the second channel 20. The third grounding portion 33 comes into contact with the ground plane H in the reference state of the head 100, along with the first grounding portion 31 and the second grounding portion 32 described above. Here, the first and second grounding portions 31 and 32 have flat surfaces that are approximately parallel with the ground plane H in a side view, but in the case of the third grounding portion 33, only the end edge on the face side that is connected to the second channel 20 comes into contact with the ground plane. According to this configuration, the head 100 comes into contact with the ground plane H in the reference state at three points, namely the first to third grounding portions 31 to 33. Accordingly, when the golfer holds the head 100 in the reference state, the head 100 is supported at a plurality of points on the ground plane H, and the head 100 is stable.

The following is a comparison of the first channel 10 and the second channel 20 described above. First, the first apex portion 13 of the first channel 10 is at a lower position than the second apex portion 23 of the second channel 20 is. In other words, as shown in FIG. 7, a depth d1 of the first channel 10 from the reference plane H is smaller than a depth d2 of the second channel 20. Also, a length w1 of the first channel 10 in the face-back direction is longer than a length w2 of the second channel 20 in the face-back direction.

Also, a recessed portion having a trapezoidal shape in a plan view is formed in the sole portion 3 in a region in approximately the center in the toe-heel direction on the back side of the second channel 20, and a weight 60 can be removably attached to this recessed portion using a screw. Accordingly, the center of gravity of the head 100 can be adjusted so as to approach the center on the back side, thus achieving an even lower center of gravity.

4. Features

The golf club head of the present embodiment can obtain effects such as the following.

<4-1>

Figure 8:
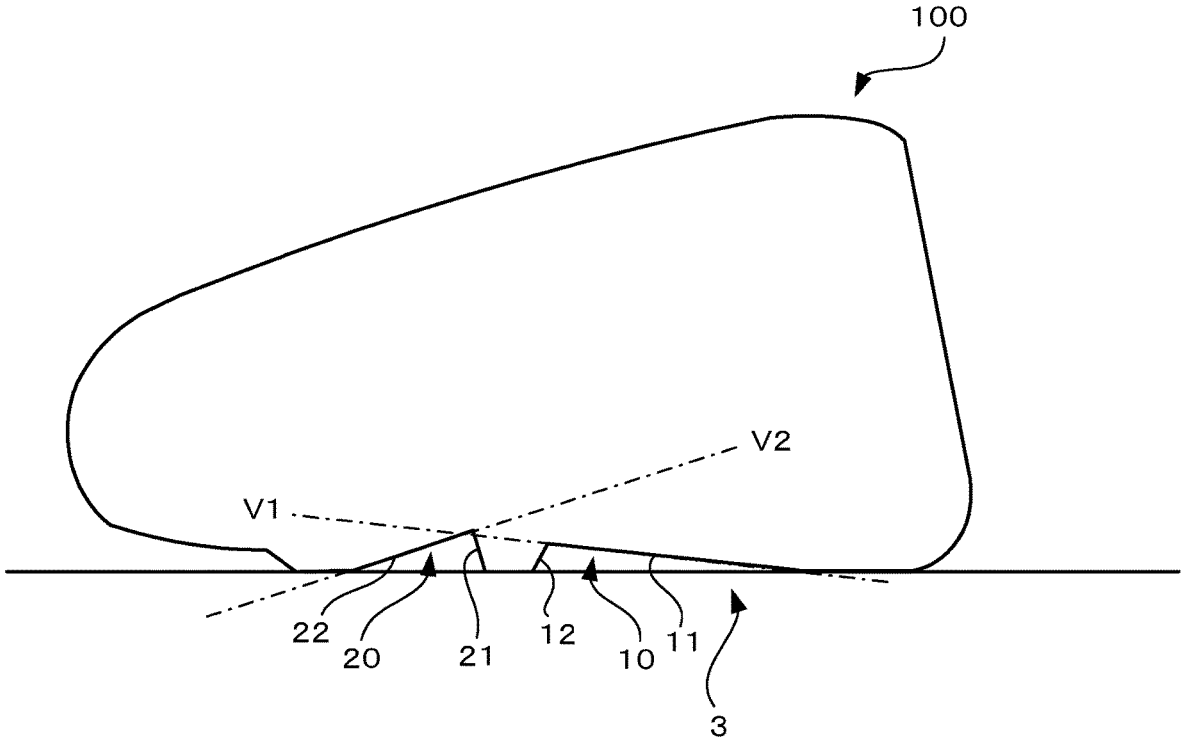
FIG. 8 is a schematic side cross-sectional view of the golf club head in FIG. 1.

As described above, the majority of the first channel 10 is constituted by the first main inner wall 11, and the first main inner wall 11 is inclined so as to extend upward while extending toward the back side. On the other hand, the majority of the second channel 20, which is on the back side of the first channel 10, is constituted by the second main inner wall 22, and the second main inner wall 22 is inclined so as to extend upward while extending toward the face side. Here, as shown in FIG. 8, a virtual line V1 extending in the face-back direction is set along the first main inner wall 11, and a virtual line V2 extending in the face-back direction is set along the second main inner wall 22. In this case, the virtual lines V1 and V2 intersect so as to form a peak in the interior space of the head 100, and therefore the first channel 10 and the second channel 20 form a mountain shape overall. Accordingly, when ball impact force acts on the face portion 1, due to the mountain shape of the first channel 10 and the second channel 20, the sole portion 3 is likely to deform so as to recede toward the interior space side, thus making it possible to improve the rebound performance of the head 100.

<4-2>

Although the first channel 10 and the second channel 20 form a mountain shape overall, a configuration is conceivable in which, for example, the first sub inner wall 12 and the second sub inner wall 21 are omitted, and a channel is formed by directly connecting the first main inner wall 11 and the second main inner wall 22, but in this case, the overall depth of the channel increases, thus leading to a problem in that lowering the center of gravity of the head 100 is inhibited. In contrast, in the present embodiment, the first channel 10 and the second channel 20 are separated, and one of them is given a shallower depth, thus suppressing the overall depth of the channels and making it possible to lower the center of gravity of the head 100.

Here, if the distance between the first channel 10 and the second channel 20, that is to say a length L3 of the second grounding portion 32 in the face-back direction (length at the narrowest portion; see FIG. 6), is too large, there is a risk that the sole portion 3 will be less likely to undergo deformation attributed to the above-described mountain shape. Also, the area of the sole portion 3 is limited, and therefore if the distance between the first channel 10 and the second channel 20 is increased, the widths of the channels 10 and 20 need to be reduced, thus also leading to the risk that the sole portion 3 will be less likely to undergo the above-described deformation. However, if the length L3 is too small, stress becomes concentrated with the second grounding portion 32 deforms, and there is a risk of a decrease in the strength of the sole portion 3. In view of the above, it is preferable that the length L3 is in the range of 4 mm to 15 mm inclusive, for example.

<4-3>

Also, the face portion 1 is commonly designed to have higher rigidity than the sole portion 3, because durability against impact when striking balls is sought. Therefore, the rigidity of the sole portion 3 increases in the vicinity of the face portion 1, and so the sole portion 3 tends to not readily deform. In view of this, if the two channels 10 and 20 are formed in the sole portion 3 as described above, the first channel 10 located in the vicinity of the face portion 1 contributes to reducing the rigidity of the sole portion 3, but the degree of that contribution is less than that of the second channel 20 located farther on the back side. Accordingly, in the present embodiment, the relationship between the depth d1 of the first channel 10 and the depth d2 of the second channel 20 is set to d2>d1. That is, the second channel 20 on the back side is formed relatively deeper due to its effective contribution to reducing rigidity, and the first channel 10 on the face side is formed relatively shallower due to being relatively less likely to contribute to reducing rigidity. As a result, while mainly effectively increasing rebound performance by the second channel 20 on the back side, a rise in the position of the center of gravity is prevented by shallowly forming the first channel 10 on the face side. That is, low center of gravity is achieved.

<4-4>

Also, the relationships between the lengths in the face-back direction and the depths of the channels 10 and 20 can be set as follows. First, in the case of the first channel 10, it is preferable that w1/d1>1, more preferable that w1/d1>3, and still more preferable that w1/d1>6. Under such conditions, the first channel 10 relatively widens in the face-back direction and becomes shallower in the vertical direction. Accordingly, two essentially contradictory requirements of improving the rebound performance of the sole portion 3 and lowering the center of gravity of the head 100 can be satisfied with good balance.

Similarly, in the case of the second channel 20, it is preferable that w2/d2>1, more preferable that w2/d2>3, and still more preferable that w2/d2>5. Under such conditions as well, the second channel 20 relatively widens in the front-back direction and becomes shallower in the vertical direction. Accordingly, similarly to the first channel 10, two essentially contradictory requirements of improving the rebound performance of the sole portion 3 and lowering the center of gravity of the head 100 can be satisfied with good balance. Also, with such a relationship, the first channel 10 and the second channel 20 can form a mountain shape overall, as described in section 4-1 above.

From the above viewpoint, it is preferable that 15 mm≤w1≤50 mm, and preferable that 5 mm≤w2≤40 mm. Also, it is preferable that 0.3 mm≤d1≤4 mm, and preferable that 0.5 mm≤d2≤5 mm. Further, it is preferable that d2/w2>d1/w1.

In the present embodiment, quantitative conditions related to d1, d2, w1 and w2 are established across the entire region in the toe-heel direction where the first channel 10 and the second channel 20 are formed. However, these conditions may also be partially established in the toe-heel direction. In that case, it is preferable that these conditions are satisfied at least in a cross-section passing through the face center Fc and orthogonal to the toe-heel direction, that is, on the cross-section shown in FIGS. 3 and 6.

<4-5>

As described above, in the sole portion 3, the second channel 20 arranged on the back side contributes to deformation to a larger degree. From this viewpoint, the position of the second channel 20 can be set as follows. First, as shown in FIG. 6, in the reference state, let L1 be the length of the head 100 in the face-back direction, and let L2 be the length in the face-back direction from the frontmost point of the head 100 (the frontmost point of the leading edge) to the face-side edge of the second channel 20 (see FIG. 6). Note that L1 is the length in the face-back direction from the frontmost point of the head 100 to the rearmost point of the head 100.

At this time, in the present embodiment, it is preferable that L2/L1≥0.4, more preferable that L2/L1≥0.45, and still more preferable that L2/L1≥0.5. Accordingly, the second channel 20 is arranged farther on the back side, and it is less likely to be influenced by the property that the sole portion 3 is not likely to deform due to the high rigidity of the face portion 1. As a result, it is possible to effectively improve the rebound performance of the sole portion 3.

Further, it is preferable that L2/L1≤0.8, more preferable that L2/L1≤0.7, and still more preferable that L2/L1≤0.6. Under such conditions, the second channel 20 will not descend too far rearward. That is, if the second channel 20 excessively descends to the rear, in other words, if the second channel 20 is too far from the surface of the face, deformation when striking a ball becomes difficult to attain in the vicinity of the second channel 20, and the amount of deflection in the vicinity of the second channel 20 can decrease. Also, even if the second channel 20 becomes too close to the outer shell of the rigid back side of the head 100, the amount of deflection in the vicinity of the second channel 20 can decrease. Accordingly, from the viewpoint of improving rebound performance, it is preferable to adopt a configuration in which the second channel 20 does not descend too far rearward.

Because L2 is defined based on the edge on the face side of the curved second channel 20, L2 varies according to position in the toe-heel direction, but in the present embodiment, the numerical conditions related to L2/L1 above are established across the entire region in the toe-heel direction where the channel 20 is formed. However, the above numerical conditions may also be partially established in the toe-heel direction. In that case, it is preferable that the above numerical conditions are satisfied at least in a cross-section passing through the face center Fc and orthogonal to the toe-heel direction, that is, on the cross section shown in FIGS. 3 and 8.

<4-6>

Also, in the above embodiment, the first channel 10 that is closer to the face side is made shallower. Therefore, there is an advantage in that it is less likely for the sole portion 3 to catch on the ground plane H (grass) when swinging the golf club, and the sole portion 3 more easily slips along the ground plane H.

<4-7>

Figure 10:
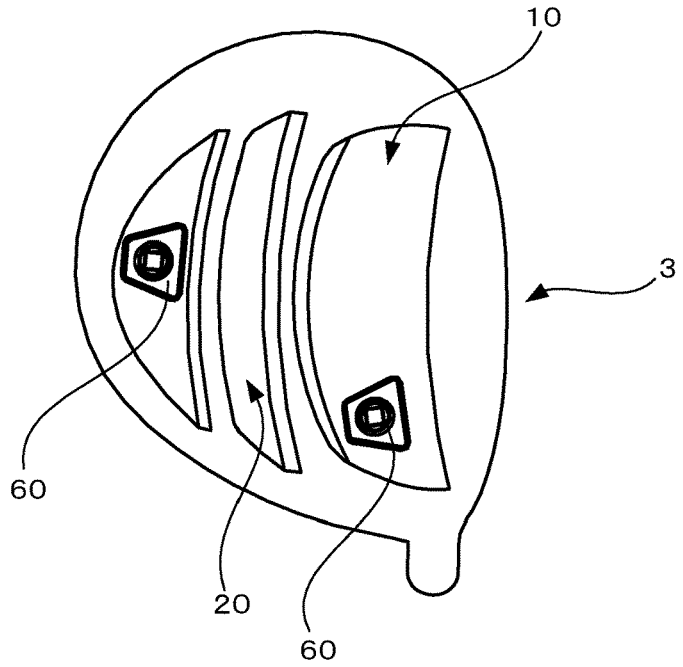
FIG. 10 is a bottom face view in a reference state of another golf club head according to the present invention.
Figure 11:
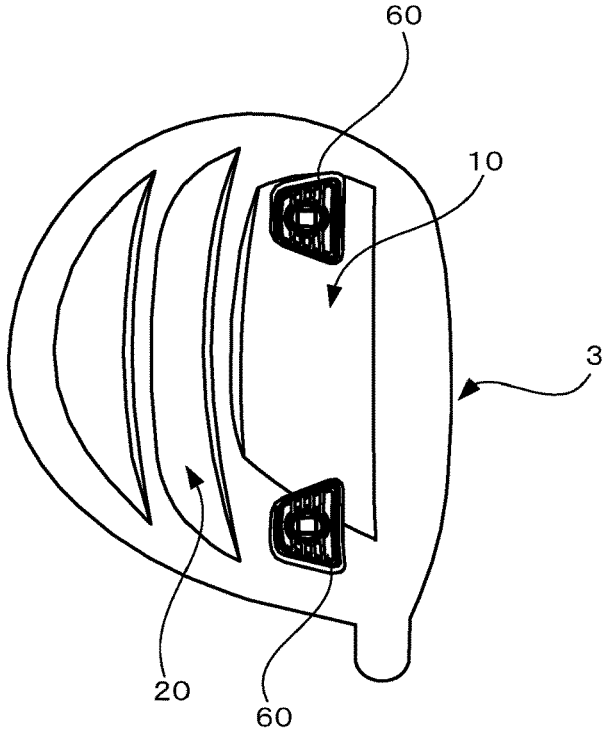
FIG. 11 is a bottom face view in a reference state of another golf club head according to the present invention.
Figure 14:
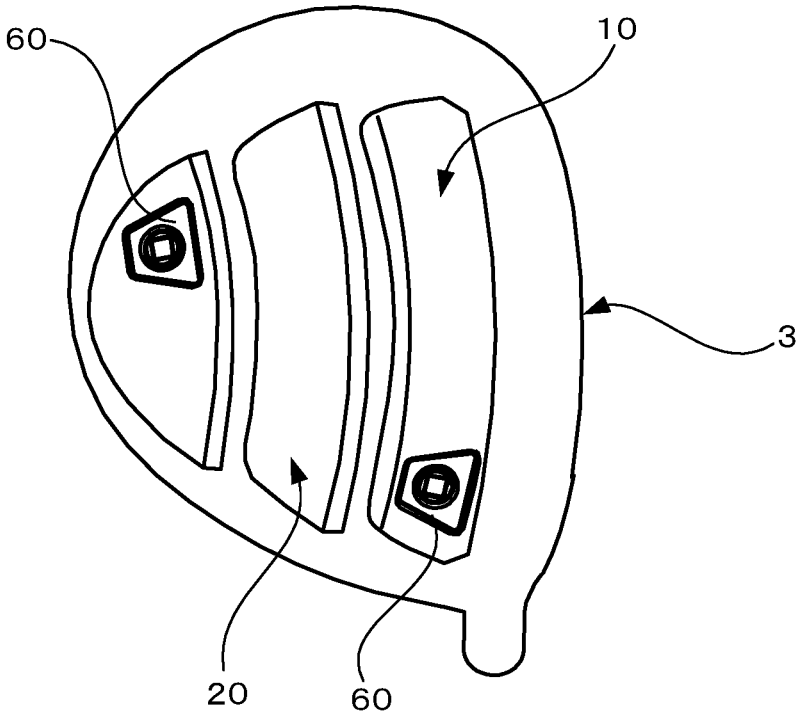
FIG. 14 is a bottom face view in a reference state of another golf club head according to the present invention.

The second channel 20 is formed, on the sole portion 3, across generally the entire region in the toe-heel direction, and the first channel 10 is formed, on the sole portion 3, only at a position nearer the toe-side in the toe-heel direction. In other words, the first channel 10 on the face side is shorter in the toe-heel direction than the second channel 20 on the back side. As a result, the rebound performance is particularly improved at the position on the toe side where the first channel 10 is formed. Note that the position in the toe-heel direction where the first channel 10 can be formed is not limited to the example here. That is, the first channel 10 can be selectively formed at an arbitrary position in the toe-heel direction where the rebound performance is particularly desired to be improved. However, as shown in FIGS. 10, 11, and 14 that will be described later, the first channel 10 may be formed on the sole portion 3 across generally the entire region in the toe-heel direction. Also, either of the lengths in the toe-heel direction of the first channel 10 and the second channel 20 may be set longer, and these lengths can be changed as appropriate.

<4-8>

In the present embodiment, in the bottom face view, the first channel 10 and the second channel 20 depict circular arcs (curved lines) in which the vicinity of the center in the toe-heel direction protrudes toward the backside. As a result, the distance from the face center Fc where striking points concentrate to the first channel 10 can be generally equal across the entire region of the first channel 10 in the toe-heel direction. Similarly with regard to the second channel 20, the distance from the face center Fc to the second channel 20 can be generally equal across the entire region of the second channel 20 in the toe-heel direction. Thus, it is possible to effectively deform the vicinity of the first channel 10 and the second channel 20 when striking a ball.

5. Variations

Several embodiments of the present invention are described above, but the present invention is not limited to the above embodiments, and various modifications that do not depart from the gist of the invention can be made. For example, the below changes are possible. Also, the gist of the following variations can be combined as appropriate.

<5-1>

Figure 9:
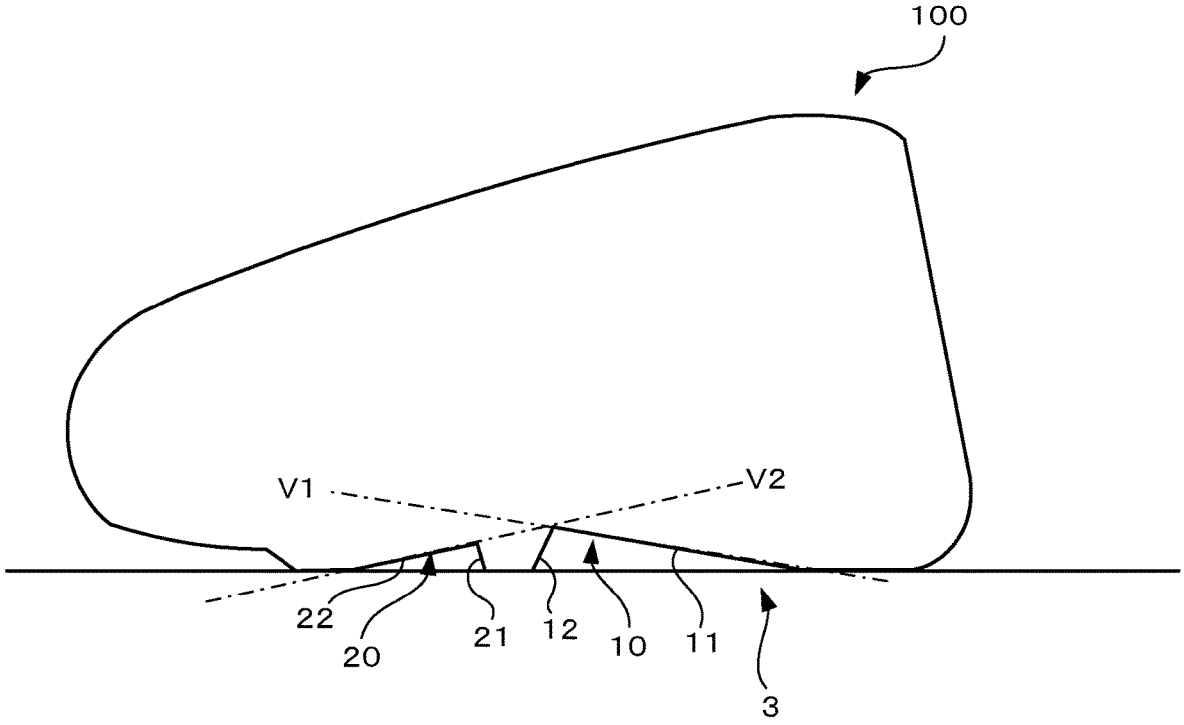
FIG. 9 is a schematic side cross-sectional view of another golf club head according to the present invention.

Although the second channel 20 is formed deeper than the first channel 10 in the above embodiment, the first channel 10 can be formed deeper as shown in FIG. 9. Even in this case, the first channel 10 and the second channel 20 forma mountain shape overall, and the sole portion 3 more easily deforms so as to recede toward the interior space. As a result, it is possible to improve the rebound performance of the head 100.

<5-2>

Although the weight is arranged on the back side relative to the second channel 20 in the above embodiment, the shape, number, and attachment location of the weight 60 are not limited to this. In other words, the present invention is not limited to this, and any number of weights 60 can be attached at any positions in accordance with the center of gravity position that is the design target. For example, in the example of FIG. 10, a weight 60 is attached not only to the rear of the sole portion 3 but also to a heel side position in the first channel 10, so that the center of gravity can approach the heel side. Further, in the example of FIG. 11, there is no weight 60 to the rear of the sole portion 3, and weights 60 are attached at two locations on the toe side and the heel side in the first channel 10, and so the center of gravity can be brought closer to the face side. In the example of later-described FIG. 14, a weight 60 located to the rear of the sole portion 3 is moved slightly toward the toe side, and a weight 60 is also attached to a position on the heel side in the first channel 10. Also, the weight can have various shapes other than a trapezoid in a plan view, such as a circular shape or a polygonal shape.

<5-3>

Figure 12A:
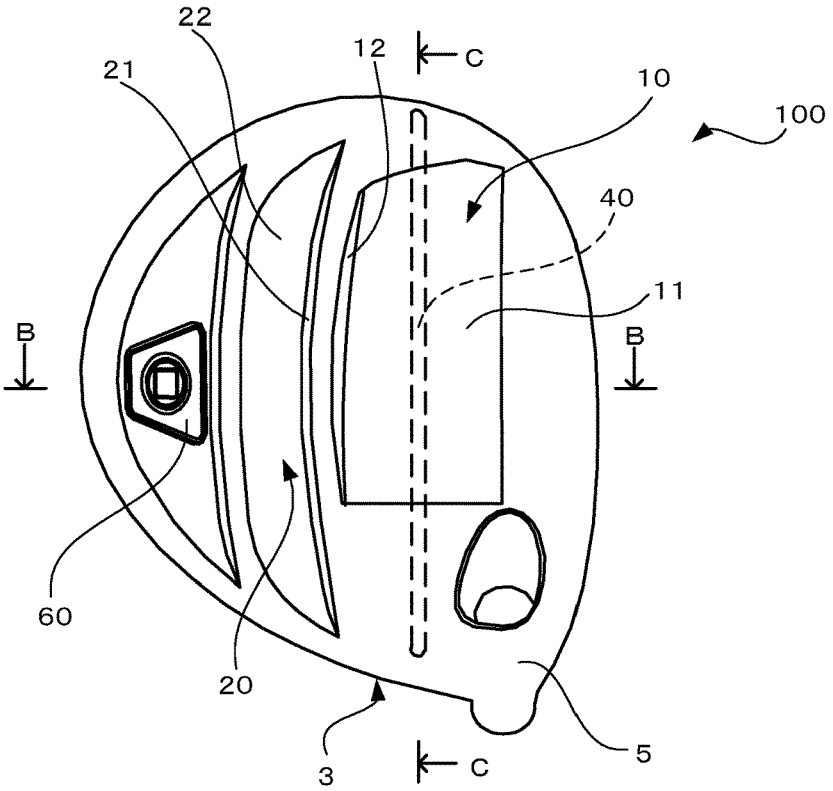
FIG. 12A is a bottom face view in a reference state of another golf club head according to the present invention.
Figure 12B:
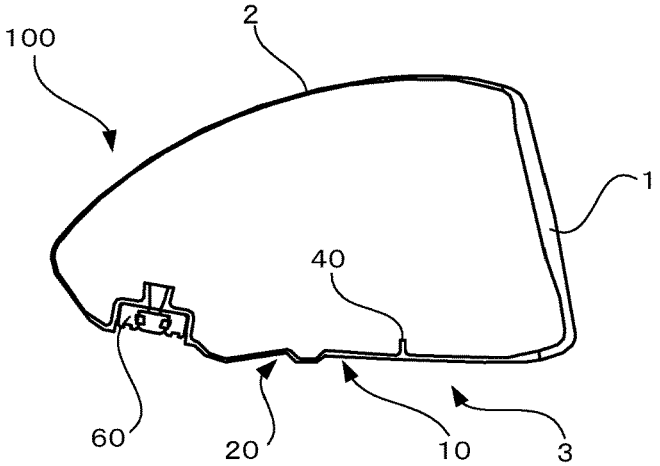
FIG. 12B is cross-sectional view taken along line B-B in FIG. 12A.
Figure 12C:
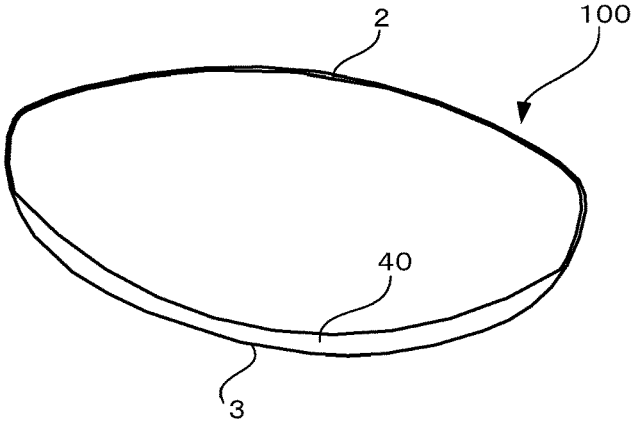
FIG. 12C is cross-sectional view taken along line C-C in FIG. 12A.

The golf club head according to the present invention makes it possible to forma thick portion on the interior space side of the sole portion 3. The thick portion can have various modes. For example, as shown in FIGS. 12A to 12C, a rib-shaped thick portion 40 that extends in the toe-heel direction can be formed in the central region, with respect to the face-back direction, of the first main inner wall 11. This thick portion 40 extends across generally the entire region of the sole portion in the toe-heel direction. Also, although the thick portion 40 extends in a straight line in this example, the thick portion 40 may be curved so as to conform to the shape of the first channel 10 and protrude toward the back side, for example.

Even if such a thick portion 40 is provided, since the increase in rigidity in the face-back direction is small, it is possible to substantially maintain the rebound performance in the face-back direction. On the other hand, since the thick portion 40 can increase the rigidity in the toe-heel direction of the sole portion 3, the volume of a ball-striking sound can be increased.

This sort of thick portion 40 is not limited to the first main inner wall 11, and can also be formed in the second main inner wall 22. Also, such a thick portion 40 may be provided at a plurality of locations.

Figure 13A:
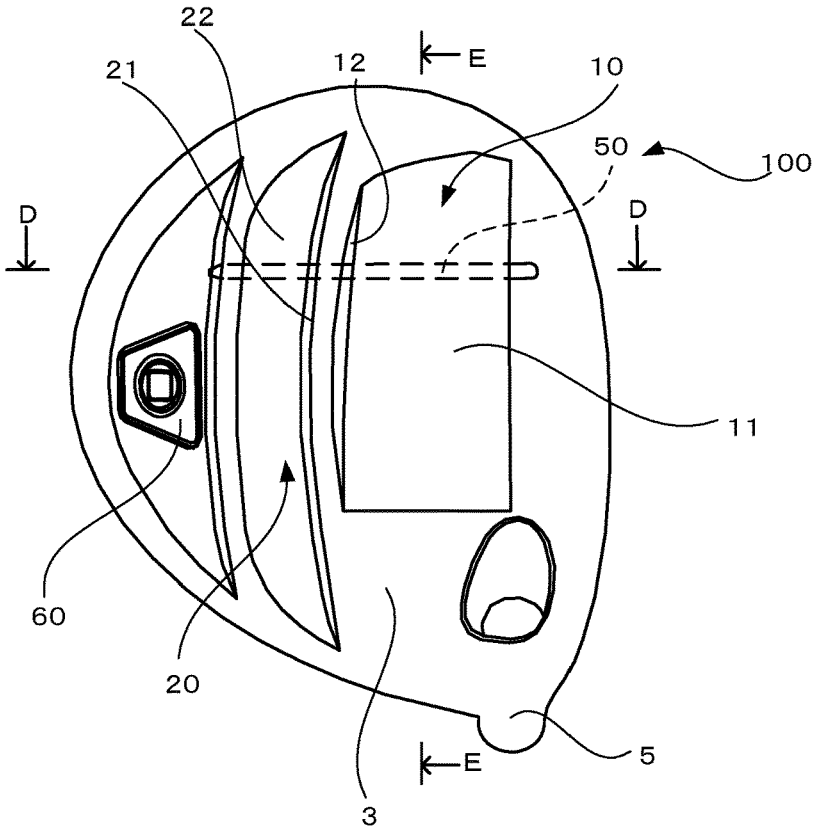
FIG. 13A is a bottom face view in a reference state of another golf club head according to the present invention.
Figure 13B:
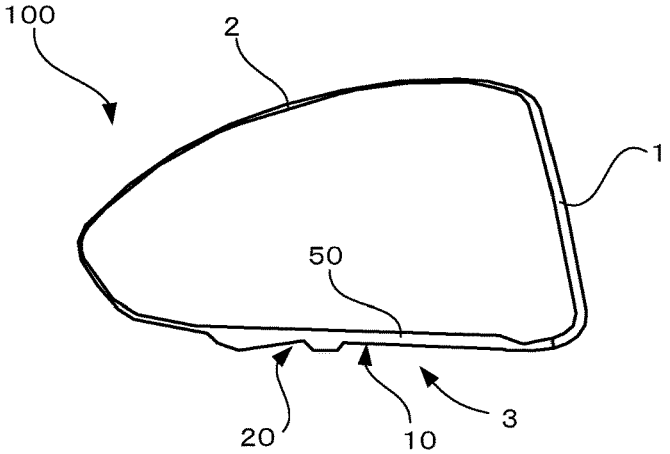
FIG. 13B is cross-sectional view taken along line D-D in FIG. 13A.
Figure 13C:
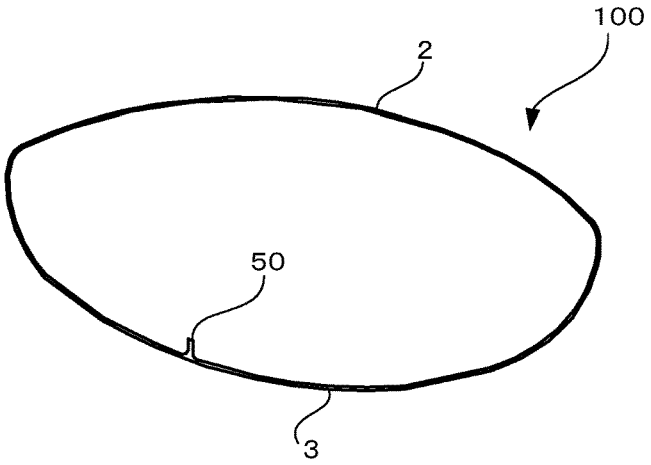
FIG. 13C is cross-sectional view taken along line E-E in FIG. 13A.

Also, a thick portion that extends in the face-back direction can be formed. For example, in an example shown in FIGS. 13A to 13C, a thick portion 50 that extends in the face-back direction across both the first channel 10 and the second channel 20 is formed. This thick portion 50 completely traverses the first channel 10 and the second channel 20. However, the thick portion 50 can also be configured so as to only extend to a position of the first channel 10, and not overlap the position of the second channel 20.

This thick portion 50 is disposed at a position closer to the toe on the sole portion 3, and therefore it is possible to increase the rigidity of the sole portion 3 and suppress rebound performance on the toe side. On the other hand, at the position where the thick portion is not provided in the toe-heel direction, improvement of the rebound performance by the first channel 10 and the second channel 20 is maintained. Note that the position in the toe-heel direction where the thick portion 50 can be formed is not limited to the example here, and it is possible to selectively form the thick portion 50 at an arbitrary position in the toe-heel direction where it is desired to suppress the rebound performance. Also, such a thick portion 50 can be provided at a plurality of locations.

The above-described thick portions 40 and 50 may be thin projection ribs as shown in the examples in FIGS. 12A to 13C, or may be formed with a belt shape having a larger width.

<5-4>

Although three grounding portions 31 to 33 that come into contact with the ground plane are provided in the sole portion in the above embodiment, any one of them may be omitted. For example, even if the third grounding portion 33 is omitted, the head 100 is supported at two points, and therefore the head 100 can be stabilized. In particular, the first grounding portion 31 and the second grounding portion 32 are flat in the side cross-sectional view and are in contact in a line with the ground plane H in the side cross-sectional view. Accordingly, it is difficult for the head 100 in the reference state to fall forward or rearward, and the head 100 in the reference state is stabilized.

<5-5>

Although the channels 10 and 20 are somewhat curved so as to protrude toward the back side in the above embodiment, either or both of them can extend parallel with the toe-heel direction. Alternatively, the channel 10 can be formed depicting a circular arc (curved line) such that the vicinity of the center in the toe-heel direction protrudes toward the face side as shown in FIG. 14. This is similarly true regarding the second channel 20.

<5-6>

In the present invention, there are no particular limitations on the "main inner walls 11 and 22" of the channels 10 and 20, as long as they are, out of the inner walls that form the channels 10 and 20, inner walls having a length in the face-back direction that is larger than 50% of the widths in the face-back direction (lengths) of the channels 10 and 20, and are longer than the "sub inner walls 12 and 21". For example, the inclination angles of the inner walls forming the first channel 10 and the second channel 20 also are not limited to those shown in the first embodiment, and it is sufficient that the virtual line V1 that extends along the first main inner wall 11 and the virtual line V2 that extends along the second main inner wall 22 intersect so as to protrude toward the interior space side of the head 100.

Also, the main inner walls 11 and 22 and the sub inner walls 12 and 21 can be formed by connecting a plurality of surfaces, as long as they are inclined in the same direction. Furthermore, another inner wall can be provided between the main inner walls 11 and 22 and the sub inner walls 12 and 21. Although there are no particular limitations on the inclination angle of this intervening inner wall, it may be parallel with the ground plane, for example.

<5-7>

In the above embodiment, the quantity of channels formed in the sole portion 3 is two, but the quantity of channels is not limited to this, and may be three or more. In this case, two adjacent channels correspond to the first channel and the second channel in the present invention.

<5-8>

In the above embodiment, the golf club head is a driver-type-head, but the head type is not limited, and may be another wood type such as a fairway wood, or may be a so-called utility-type-head, a hybrid-type-head, or the like.

<5-9>

The face member 102 does not need to be a cup-face-type, and for example, in a plate-type face member with the peripheral portion 15 omitted, it is possible to weld to an opening portion formed in the face portion.

REFERENCE SIGNS LIST

1 Face portion
2 Crown portion
3 Sole portion
10 First channel
20 Second channel
11 First main inner wall
12 First sub inner wall
21 Second sub inner wall
22 Second main inner wall
31 First grounding portion
32 Second grounding portion
33 Third grounding portion
40 Thick portion
50 Thick portion

The invention claimed is:

1. A golf club head comprising:
a face portion;
a crown portion; and
a sole portion,
wherein the golf club head has an interior space surrounded by the face portion, the crown portion, and the sole portion,
wherein a first channel and a second channel that extend in a toe-heel direction and are recessed toward the interior space are formed in the sole portion,
wherein said first and second channels are curved so as to protrude toward a back side in a bottom face view,
wherein the first channel is disposed on a face side relative to the second channel,
wherein the first channel has a first main inner wall disposed on the face side, and a first sub inner wall disposed on the back side,
wherein the first main inner wall is formed with a longer length in a face-back direction than the first sub inner wall, and is inclined so as to extend upward while extending toward the back side,
wherein the second channel has a second sub inner wall disposed on the face side, and a second main inner wall disposed on the back side,
wherein the second main inner wall is formed with a longer length in the face-back direction than the second sub inner wall, and is inclined so as to extend upward while extending toward the face side, and
wherein when, in the reference state, the length of the head in the face-back direction is L1 and the length in the face-back direction from the front-most point of the head to the face-side edge of the second channel is L2, then:

$$L2/L1 \geq 0.4.$$

2. The golf club head according to claim 1, wherein the second channel is deeper than the first channel.

3. The golf club head according to claim 1,
wherein the first channel is formed due to the first main inner wall disposed on the face side being connected to the first sub inner wall disposed on the back side, and
the second channel is formed due to the second sub inner wall disposed on the face side being connected to the second main inner wall disposed on the back side.

4. The golf club head according to claim 1,
wherein the sole portion further includes
a first grounding portion positioned on the face side relative to the first channel and contacting a ground plane when the sole portion has been placed on the ground plane, and
a second grounding portion positioned between the first channel and the second channel and contacting the ground plane when the sole portion has been placed on the ground plane.

5. The golf club head according to claim 4, wherein the sole portion further includes a third grounding portion positioned on the back side relative to the second channel and contacting the ground plane when the sole portion has been placed on the ground plane.

6. The golf club head according to claim 1, wherein in a plan view, at least one of the first channel and the second channel extends in a shape protruding toward the back side.

7. A golf club head comprising:

a face portion;

a crown portion; and a sole portion, wherein the golf club head has an interior space surrounded by the face portion, the crown portion, and the sole portion, wherein a first channel and a second channel that extend in a toe-heel direction and are recessed toward the interior space are formed in the sole portion, wherein said first and second channels are curved so as to protrude toward a back side in a bottom face view, wherein the first channel is disposed on a face side relative to the second channel, wherein the first channel has a first main inner wall disposed on the face side, and a first sub inner wall disposed on the back side, wherein the first main inner wall is formed with a longer length in a face-back direction than the first sub inner wall, and is inclined so as to extend upward while extending toward the back side, wherein the second channel has a second sub inner wall disposed on the face side, and a second main inner wall disposed on the back side, wherein the second main inner wall is formed with a longer length in the face-back direction than the second sub inner wall, and is inclined so as to extend upward while extending toward the face side, wherein when, in the reference state, the length of the head in the face-back direction is L1 and the length in the face-back direction from the front-most point of the head to the face-side edge of the second channel is L2, then:

$$L2/L1 \geq 0.4,$$

wherein the sole portion further includes a first grounding portion positioned on the face side relative to the first channel and contacting a ground plane when the sole portion has been placed on the ground plane, and a second grounding portion positioned between the first channel and the second channel and contacting the ground plane when the sole portion has been placed on the ground plane, and wherein in the side cross-sectional view, the first grounding portion and the second grounding portion are configured so as to contact the ground plane in a line when the sole portion has been placed on the ground plane.

8. A golf club head comprising:

a face portion;

a crown portion; and a sole portion, wherein the golf club head has an interior space surrounded by the face portion, the crown portion, and the sole portion, wherein a first channel and a second channel that extend in a toe-heel direction and are recessed toward the interior space are formed in the sole portion, wherein said first and second channels are curved so as to protrude toward a back side in a bottom face view, wherein the first channel is disposed on a face side relative to the second channel, wherein the first channel has a first main inner wall disposed on the face side, and a first sub inner wall disposed on the back side, wherein the first main inner wall is formed with a longer length in a face-back direction than the first sub inner wall, and is inclined so as to extend upward while extending toward the back side, wherein the second channel has a second sub inner wall disposed on the face side, and a second main inner wall disposed on the back side, wherein the second main inner wall is formed with a longer length in the face-back direction than the second sub inner wall, and is inclined so as to extend upward while extending toward the face side, wherein when, in the reference state, the length of the head in the face-back direction is L1 and the length in the face-back direction from the front-most point of the head to the face-side edge of the second channel is L2, then:

$$L2/L1 \geq 0.4,$$

wherein the sole portion further includes a first grounding portion positioned on the face side relative to the first channel and contacting a ground plane when the sole portion has been placed on the ground plane, and a second grounding portion positioned between the first channel and the second channel and contacting the ground plane when the sole portion has been placed on the ground plane, and wherein the sole portion further includes a thick portion extending in the toe-heel direction in at least one of the first main inner wall and the second main inner wall.

9. A golf club head comprising:

a face portion;

a crown portion; and a sole portion, wherein the golf club head has an interior space surrounded by the face portion, the crown portion, and the sole portion, wherein a first channel and a second channel that extend in a toe-heel direction and are recessed toward the interior space are formed in the sole portion, wherein said first and second channels are curved so as to protrude toward a back side in a bottom face view, wherein the first channel is disposed on a face side relative to the second channel, wherein the first channel has a first main inner wall disposed on the face side, and a first sub inner wall disposed on the back side, wherein the first main inner wall is formed with a longer length in a face-back direction than the first sub inner wall, and is inclined so as to extend upward while extending toward the back side, wherein the second channel has a second sub inner wall disposed on the face side, and a second main inner wall disposed on the back side, wherein the second main inner wall is formed with a longer length in the face-back direction than the second sub inner wall, and is inclined so as to extend upward while extending toward the face side, wherein when, in the reference state, the length of the head in the face-back direction is L1 and the length in the face-back direction from the front-most point of the head to the face-side edge of the second channel is L2, then:

$$L2/L1 \geq 0.4,$$

wherein the sole portion further includes a first grounding portion positioned on the face side relative to the first channel and contacting a ground plane when the sole portion has been placed on the ground plane, and a second grounding portion positioned between the first channel and the second channel and contacting the ground plane when the sole portion has been placed on the ground plane, and wherein the sole portion further includes a thick portion extending in the face-back direction in at least a position of the first channel.

10. A golf club head comprising:

a face portion;

a crown portion; and a sole portion, wherein the golf club head has an interior space surrounded by the face portion, the crown portion, and the sole portion, wherein a first channel and a second channel that extend in a toe-heel direction and are recessed toward the interior space are formed in the sole portion, wherein said first and second channels are curved so as to protrude toward a back side in a bottom face view, wherein the first channel is disposed on a face side relative to the second channel, wherein the first channel has a first main inner wall disposed on the face side, and a first sub inner wall disposed on the back side, wherein the first main inner wall is formed with a longer length in a face-back direction than the first sub inner wall, and is inclined so as to extend upward while extending toward the back side, wherein the second channel has a second sub inner wall disposed on the face side, and a second main inner wall disposed on the back side, wherein the second main inner wall is formed with a longer length in the face-back direction than the second sub inner wall, and is inclined so as to extend upward while extending toward the face side, wherein when, in the reference state, the length of the head in the face-back direction is L1 and the length in the face-back direction from the front-most point of the head to the face-side edge of the second channel is L2, then:

$$L2/L1 \geq 0.4,$$

wherein the sole portion further includes a first grounding portion positioned on the face side relative to the first channel and contacting a ground plane when the sole portion has been placed on the ground plane, and a second grounding portion positioned between the first channel and the second channel and contacting the ground plane when the sole portion has been placed on the ground plane, and wherein the first channel is shorter than the second channel in the toe-heel direction.

* * * * *